US005775368A

United States Patent [19]

Morino

[11] Patent Number: 5,775,368

[45] Date of Patent: Jul. 7, 1998

[54] FIRST REDUCING STAGE FOR A TWO-STAGE REGULATOR

[76] Inventor: Stefano Morino, Via Anzani 2/11, I-16151 Genova, Italy

[21] Appl. No.: 758,774

[22] Filed: Dec. 3, 1996

[30] Foreign Application Priority Data

Jun. 5, 1996 [IT] Italy ..... GE96A0054

[51] Int. Cl.[6] ..... F16K 31/12

[52] U.S. Cl. ..... 137/505.25; 137/375

[58] Field of Search ..... 137/505.25, 375; 264/98

[56] References Cited

U.S. PATENT DOCUMENTS

| | | | |
|---|---|---|---|
| 1,779,503 | 10/1930 | Swindin | 137/375 |
| 1,923,306 | 8/1933 | Hagen | 137/375 |
| 1,947,257 | 2/1934 | Fritz et al. | 137/375 |
| 2,041,450 | 5/1936 | Adams | 137/375 |
| 2,792,845 | 5/1957 | Atherton et al. | 137/375 |
| 2,831,326 | 4/1958 | Richards et al. | 137/375 |
| 2,910,998 | 11/1959 | Davis | 137/375 |
| 2,983,961 | 5/1961 | Titterton et al. | 264/98 |
| 4,230,140 | 10/1980 | Hart | 137/505.25 |
| 4,353,389 | 10/1982 | Engl | 137/375 |
| 4,826,132 | 5/1989 | Moldenhauer | 137/375 |
| 4,847,166 | 7/1989 | Kaido et al. | 137/375 |
| 5,074,519 | 12/1991 | Pettus | 137/375 |
| 5,158,106 | 10/1992 | McIntosh | 137/375 |
| 5,441,074 | 8/1995 | Kjaer | 137/375 |
| 5,540,253 | 7/1996 | Junier | 137/375 |

*Primary Examiner*—Henry A. Bennett
*Assistant Examiner*—Joanne Y. Kim
*Attorney, Agent, or Firm*—Larson & Taylor

[57] ABSTRACT

First reducing stage for a two-stage regulator, including a nozzle connected by a yoke and a clamping screw to an inlet, a pressure chamber, and a shutoff member that slides, guided by a piston or by a diaphragm, inside the pressure chamber. The adjacent compensating chamber contains a helical spring coaxial with the shutoff member and the end of the shutoff member is provided with a thermally insulating component. In the compensating chamber there is interposed, between the helical spring and the tubular part of the shutoff member, for the entire length of the spring, a thermally insulating component. That side of the diaphragm which communicates with said pressure chamber also has a covering of thermally insulating material. The helical spring is completely covered in thermally insulating material.

12 Claims, 8 Drawing Sheets

21
20
10
101
111
102
3
502
302
211
II
2
1
202
401
103
502
301
2
201

21
20
10
101
111
102
604
603
3
302
211
II
1
604
401
103
202
602
301
2
201

21
20
10
101
111
102
3
902
302
211
II
1
202
401
103
902
301
2
211

21'
10'
20'
101'
111'
103'
201'
3'
333'
401'
102'
1002'
2'

FIRST REDUCING STAGE FOR A TWO-STAGE REGULATOR

BACKGROUND OF THE INVENTION

The present invention relates to two-stage regulators, and in particular relates to a first reducing stage for a two-stage regulator.

Many different types of device capable of performing this function are known. In particular, the present invention is concerned with a first reducing stage comprising a tubular shutoff member housed in two adjacent and coaxial chambers sealed off from each other, one of which chambers, known as the pressure chamber, communicates with a high-pressure gas source and includes a seat with which the end of said shutoff member engages, while the other or compensating chamber communicates with the exterior through suitable apertures.

That end of said shutoff member which is housed in said chamber is formed into a hollow piston or is connected to a diaphragm and communicates with the outlet of said reducer.

In this reducer, the expansion of the gas which, on leaving the high-pressure source, will occur in the hollow piston end of the tubular shutoff member or in the diaphragm, makes the temperature of said shutoff member and said diaphragm so low that the water present in the compensating chamber can be frozen. The formation of ice in the compensating chamber can have extremely serious consequences, such as rapid emptying of the bottle.

Utility model application GE91U000007 by the present applicant relates to a valve for an aqualung regulator, specifically a first reducing stage, of the type described above, in which, in order to overcome the disadvantages cited above, a thermally insulating component is interposed between the helical spring of the compensating chamber and the hollow piston-shaped end of the shutoff member.

In this case, however, a large portion of the tubular rod of the shutoff member that lies inside the compensating chamber is not shielded, so the efficacy of this arrangement is reduced. Furthermore the water, cooled by the uninsulated parts, can also freeze onto the helical spring, which is made of metal, so that the reducer can still be prevented from working.

SUMMARY OF THE INVENTION

It is an object of the present invention to overcome the abovementioned drawbacks by providing a first stage regulator in which the possibility of the device being prevented from functioning by water freezing in the compensating chamber is eliminated or at least minimized.

The subject of the present invention is therefore a first reducing stage for a two-stage regulator for an underwater breathing apparatus of the type described in the introduction, in which, in the compensating chamber, there is interposed, between the helical spring and the tubular shutoff member, for the entire length of said spring, a thermally insulating component.

This thermally insulating component may comprise a single sleeve deposited around the entire length of the shutoff member contained in said chamber and made of a relatively deformable material; or it may comprise two components sliding telescopically and leaktightly over each other, one being connected to the hollow piston-shaped end of the shutoff member and the other to the dividing wall positioned between the two chambers.

In addition, that side of the diaphragm which communicates with said pressure chamber also has a covering of thermally insulating material.

The helical spring located in the compensating chamber is advantageously completely covered in thermally insulating material.

In order to improve the efficacy of the device, it is also possible to make all parts of the first reducing stage of the invention in a material having high thermal conductivity.

Further advantages and features will be evident from the following description of certain embodiments of the present invention. This description is provided for illustrative purposes without any limitation being implied and refers to the accompanying drawings in which:

DESCRIPTION OF THE PREFERRED EMBODIMENTS

Figure 1:
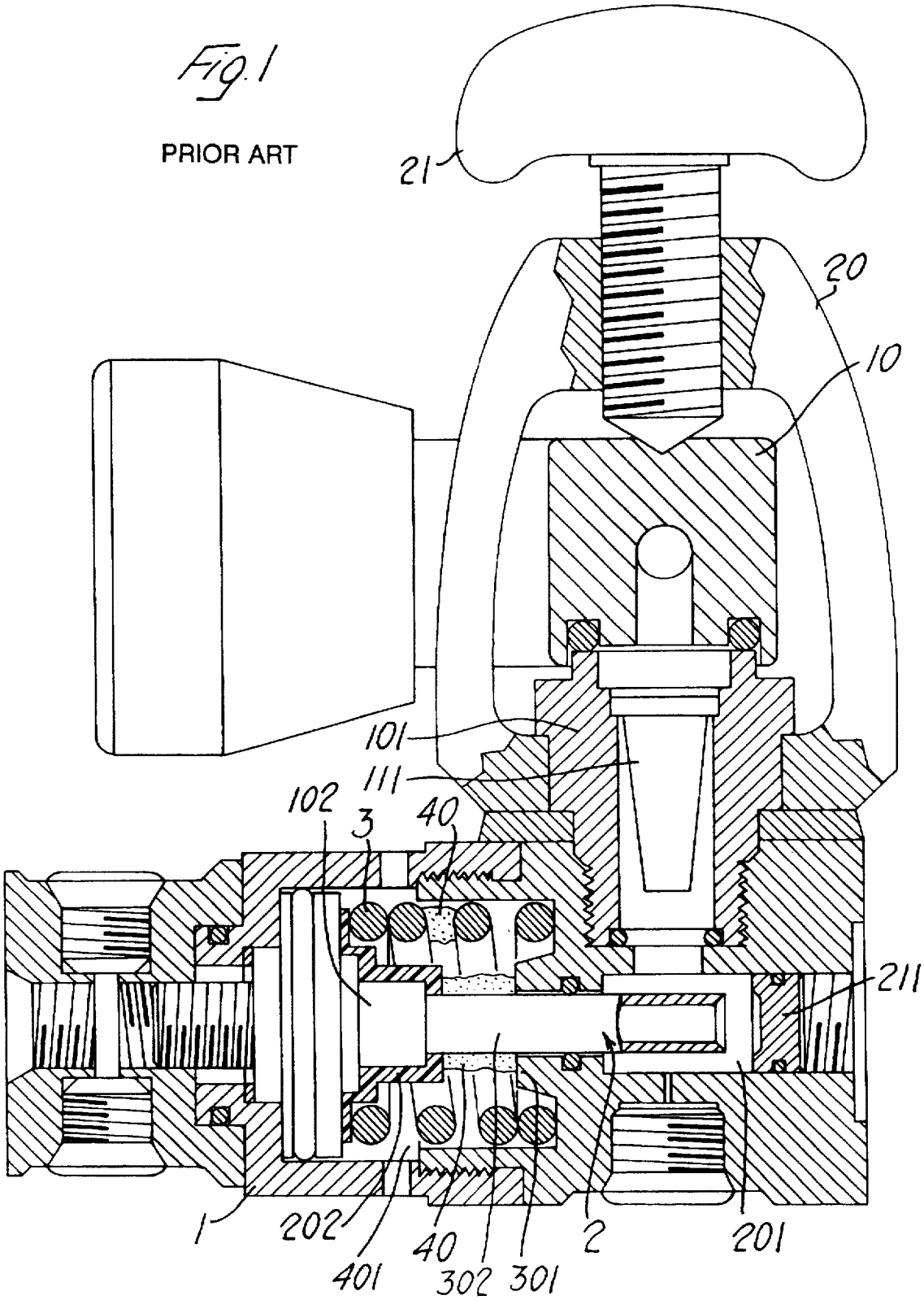
Fig. 1 PRIOR ART
FIG. 1 is a view in axial section of a first reducing stage using a hollow piston in accordance with the prior art.

In FIG. 1, the numeral 1 denotes the body of a first reducing stage of a known type. This body is connected radially to a nozzle 10 for the release of high-pressure gas, by means of the yoke 20 and the clamping screw 21 which connects this outlet to the inlet, which is fitted with a filter 111. The inlet 101 communicates with the pressure chamber 201, which is provided radially with an outlet and bounded downstream by the wall 301 and upstream by the seat 211; in said pressure chamber there slides a shutoff member 2 that passes leaktightly through the wall 301 and slides in a guided manner in the adjacent compensating chamber 401, which contains the helical spring 3 that is coaxial with said shutoff member and presses at one end on the wall 301 of the body 1 and at the other on the hollow piston-shaped end 102 of the shutoff member 2. The shutoff member 2 is fitted, in the vicinity of this hollow piston end 102, hereinafter termed the piston 102 of the shutoff member, with a thermally insulating component 202, which however does not extend along the tubular part 302 of the shutoff member, hereinafter termed the rod 302 of the shutoff member.

Consequently, as can be seen in the figure, deposits of ice 40, produced by the expansion of the gas inside the piston 102 in a known manner, form around the rod 302 and between the turns of the helical spring 3.

In the subsequent FIGS. 2 to 8, which depict all the embodiments of the first reducing stage forming the subject of the present invention, and in which identical parts are given identical numerals, that portion of the figures which lies below the indicated axis II represents the first reducing stage when the shutoff member 2 is in the closed position. In all the cited embodiments the helical spring 3, 3' has the insulating covering 103, 103'.

Figure 2:
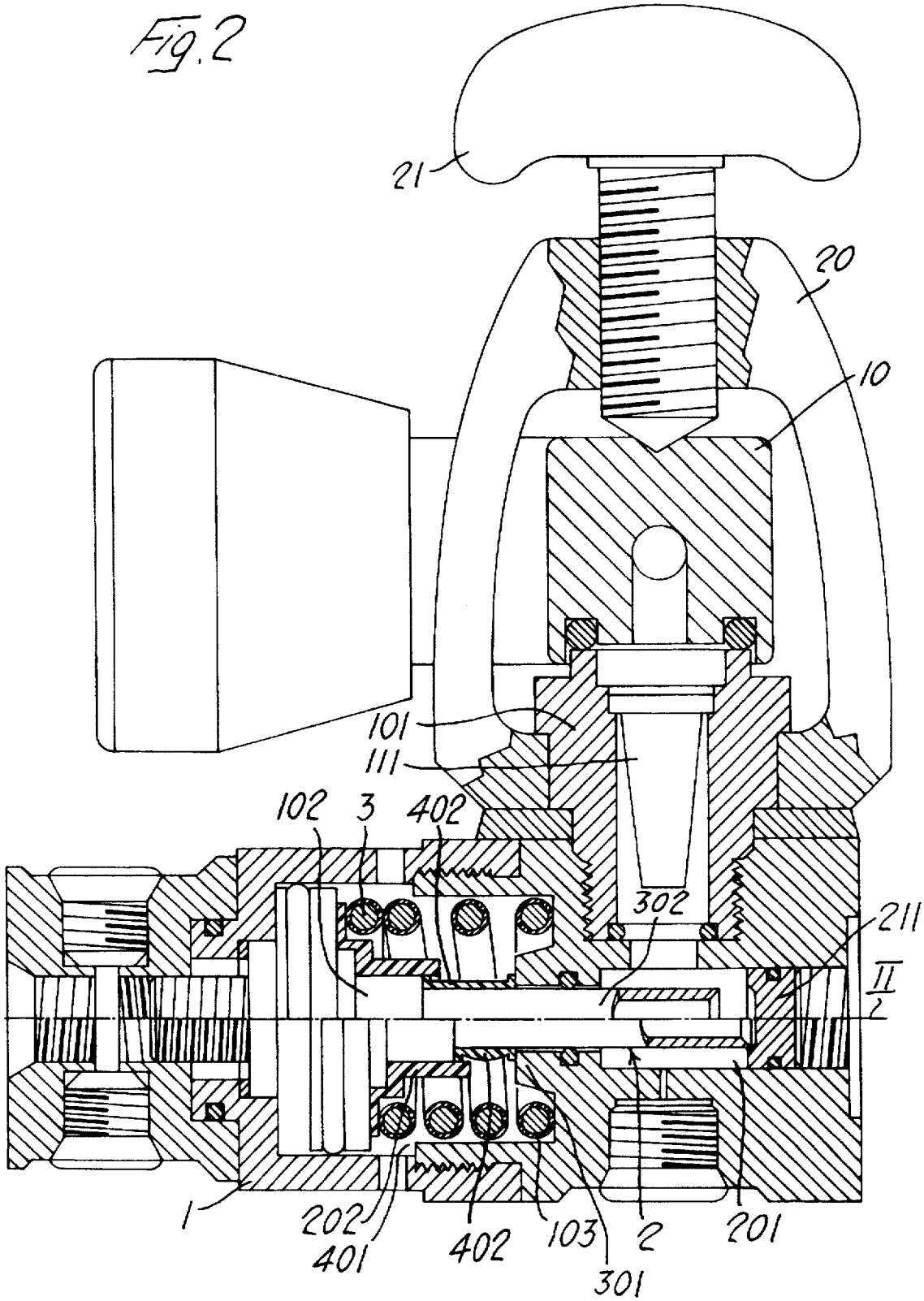
FIG. 2 is a view in axial section of a first embodiment of the present invention, with the shutoff member illustrated in the two extreme positions of its stroke.

FIG. 2 shows a first embodiment of the invention. In the figure, the rod 302 of the shutoff member possesses, inside the chamber 401, a thermally insulating component 402 with one end connected to the thermally insulating component 202 of the piston 102 of the shutoff member and the other end in contact with the dividing wall 301 positioned between the pressure chamber 201 and the compensating chamber 401.

Figure 3:
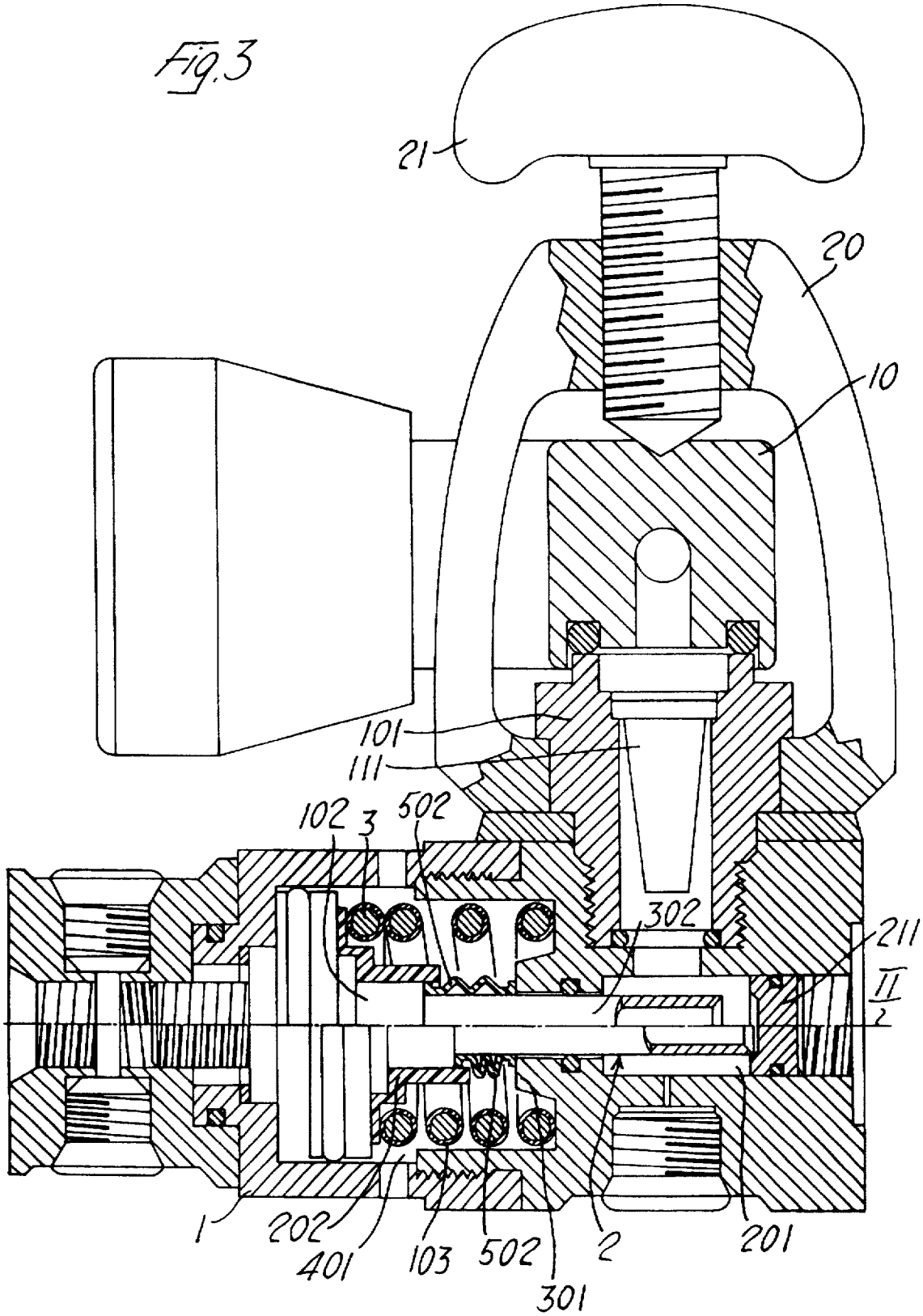
FIG. 3 is a view similar to that of FIG. 2 of a second embodiment of the invention.

FIG. 3 illustrates another embodiment of the invention. In the figure, the rod 302 of the shutoff member possesses, inside the chamber 401, a bellows-type thermally insulating component 502 with one end connected to the thermally insulating component 202 of the piston 102 of the shutoff member and the other end in contact with the dividing wall 301 positioned between the pressure chamber 201 and the compensating chamber 401.

Figure 4:
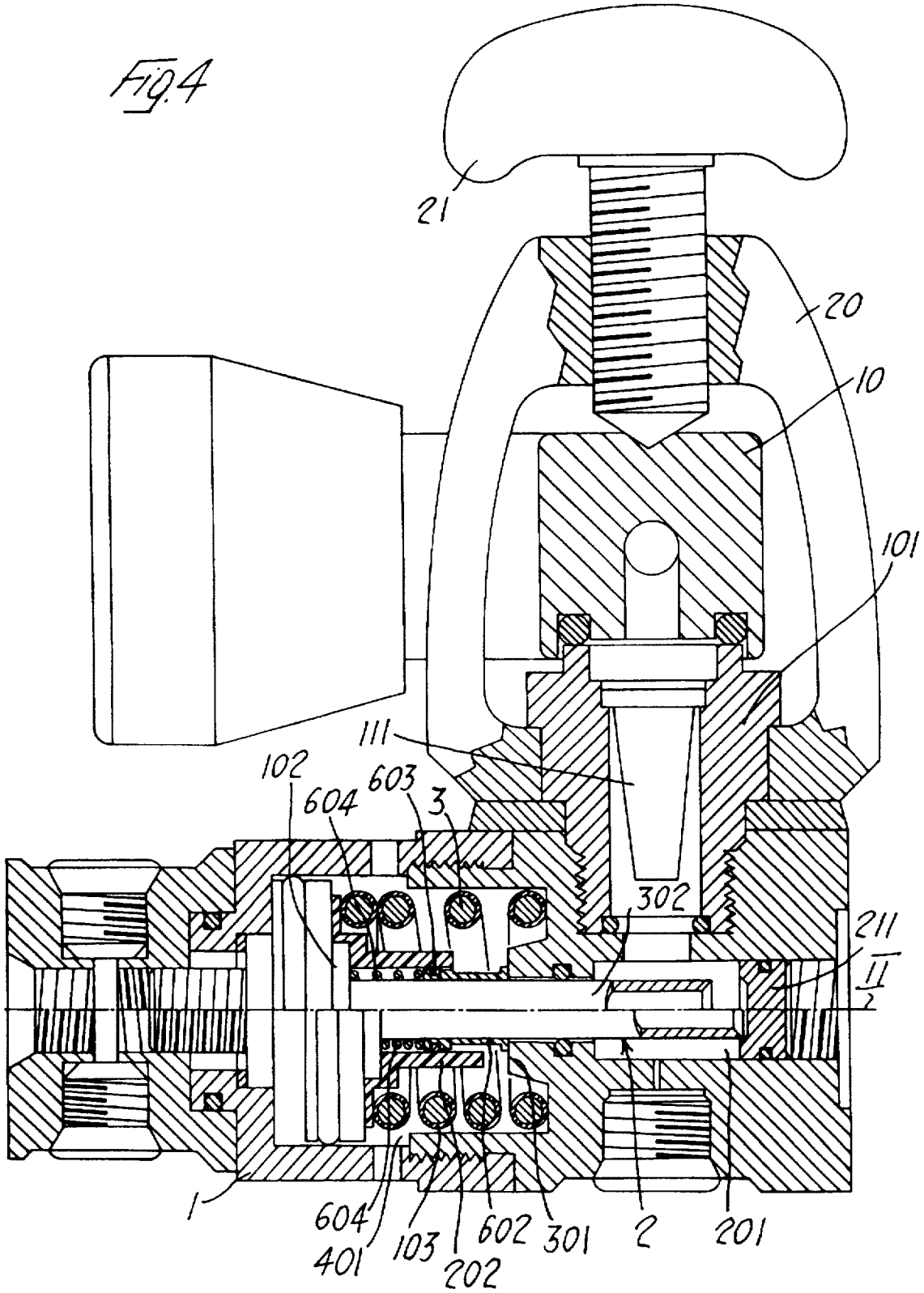
FIG. 4 is a view similar to that of FIG. 2 of a third embodiment of the invention.

FIG. 4 illustrates another embodiment of the invention. In the figure, the rod 302 of the shutoff member possesses, inside the chamber 401, a thermally insulating component 602 fitted with a seal 603 between itself and the thermally insulating component 202 of the piston 102 of the shutoff member, and a spring 604 that keeps it in contact with the wall 301. These work together as a telescopic seal around the piston rod 302.

Figure 5:
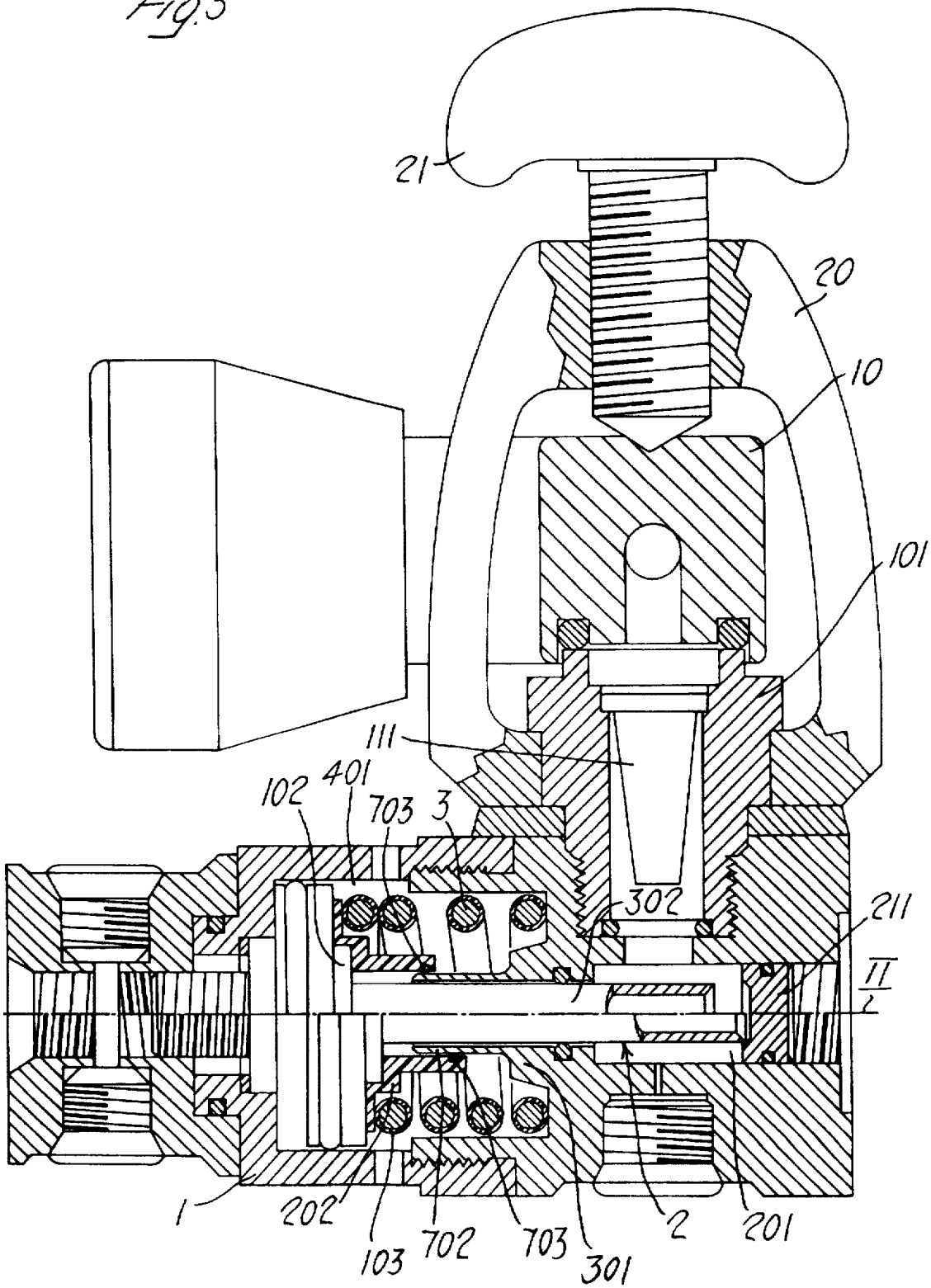
FIG. 5 is a view similar to that of FIG. 2 of a fourth embodiment of the invention.

FIG. 5 illustrates another embodiment of the invention. In the figure, the rod 302 of the shutoff member possesses, inside the chamber 401, a thermally insulating component 702 formed by the axial continuation of the wall 301; said component 702 is fitted with a seal 703 between itself and the thermally insulating component 202 of the piston 102 of the shutoff member. As in the previous embodiment, these work together as a telescopic seal around the piston rod 302.

Figure 6:
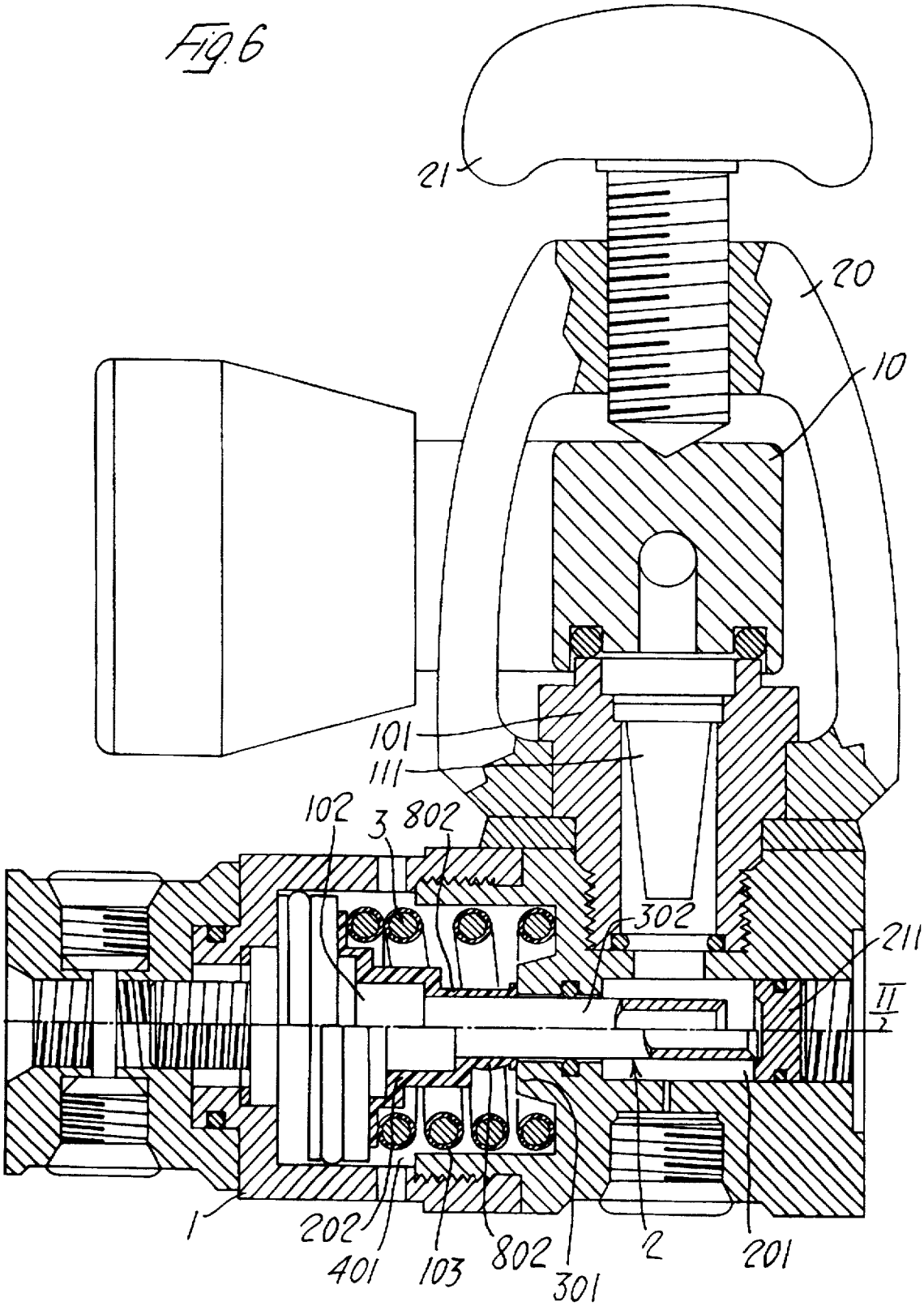
FIG. 6 is a view similar to that of FIG. 2 of a fifth embodiment of the invention.

FIG. 6 illustrates another embodiment of the invention. In the figure, the rod 302 of the shutoff member possesses, inside the chamber 401, a thermally insulating component 802 formed by the axial continuation of the thermally insulating component 202 of the piston 102; said component 802 terminates at the other end in contact with the dividing wall 301 positioned between the pressure chamber 201 and the compensating chamber 401.

Figure 7:
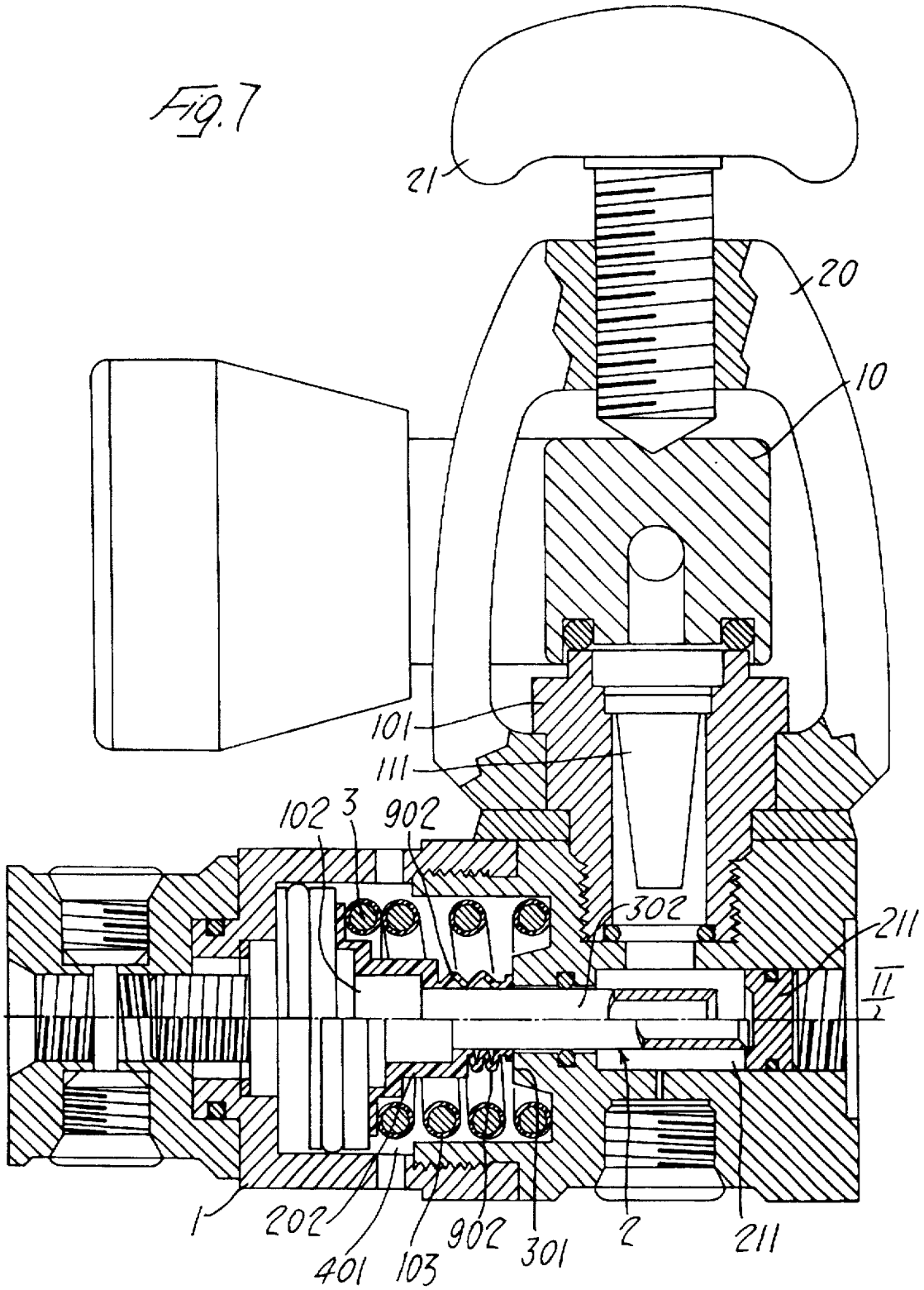
FIG. 7 is a view similar to that of FIG. 2 of sixth embodiment of the invention.

FIG. 7 illustrates another embodiment of the invention. In the figure, the rod 302 of the shutoff member possesses, inside the chamber 401, a thermally insulating component 902 formed by the axial continuation of the thermally insulating component 202 of the piston 102; said component 902 is of bellows design and terminates at the other end in contact with the dividing wall 301 positioned between the pressure chamber 201 and the compensating chamber 401.

Figure 8:
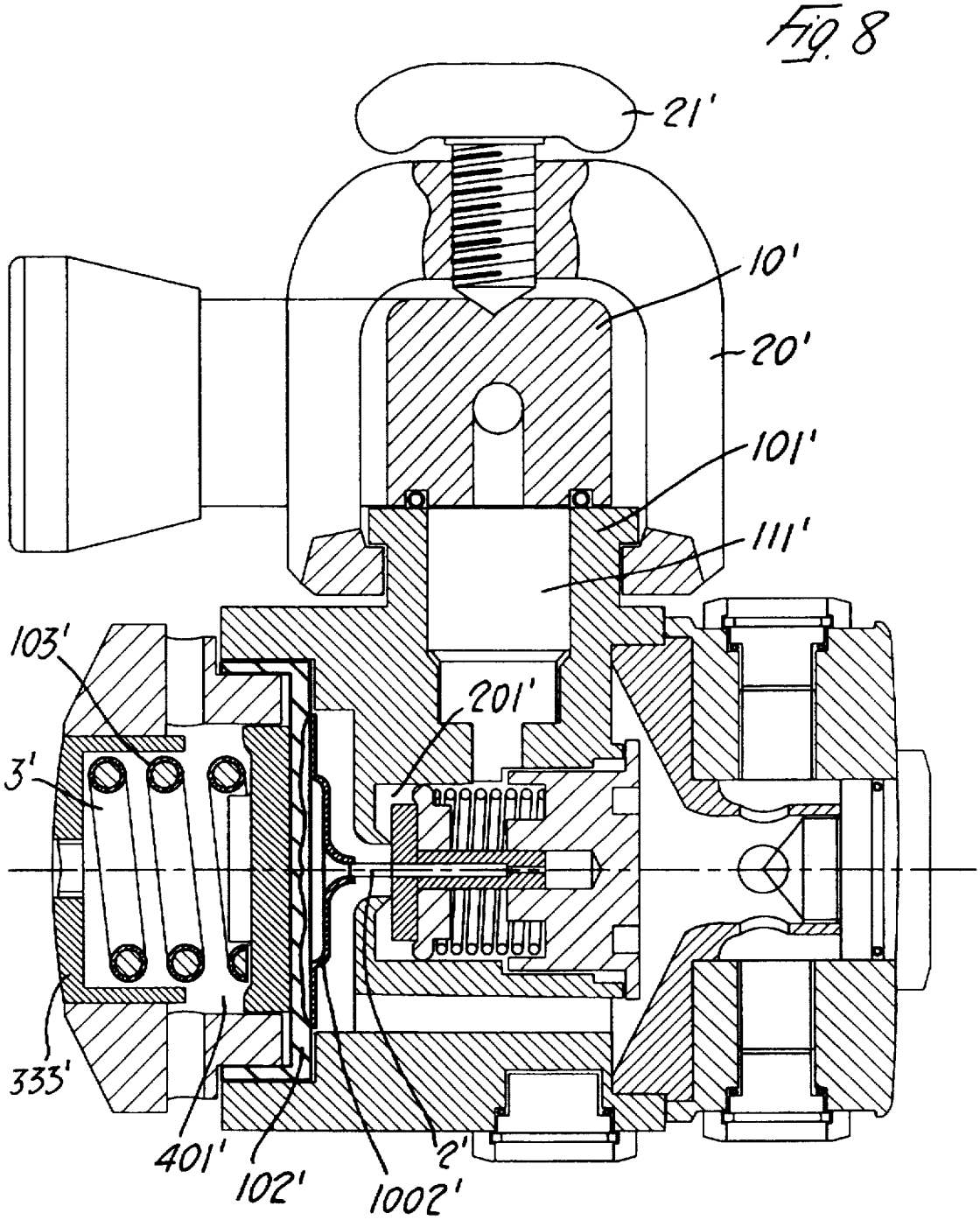
FIG. 8 is a view similar to that of FIG. 2 of a seventh embodiment of the invention in which the first stage is of the type in which the shutoff member is actuated by a diaphragm present between the compensating chamber and the high-pressure chamber.

FIG. 8 illustrates another embodiment of the invention in which the regulator first stage is of the diaphragm type.

The body is connected radially to the high-pressure gas release nozzle by means of the yoke 20' and the clamping screw 21' which connects this outlet to the inlet 101' containing a filter 111'.

This inlet communicates with the pressure chamber 201', which has an outlet in a radial position and in which there slides a shutoff member 2' connected to the diaphragm 102' that fits between the high-pressure chamber 201' and the compensating chamber 401'. In the latter is the helical spring 3' coaxial with said shutoff member, that presses at one end on the wall 333' of the regulator body and at the other is connected to this diaphragm. According to the present invention said helical spring 3' possesses the insulating covering 103'. Furthermore, that side of the diaphragm 102' which communicates with said pressure chamber 201' also has a covering 1002' of thermally insulating material.

The above detailed description of the features of the first reducing stage for a two-stage regulator forming the subject of the present invention will have made the advantages cited above clearer.

Thus, in the compensating chamber, there is interposed, between the helical spring and the tubular shutoff member, for the entire length of said spring, the abovementioned thermal insulating component that prevents the sudden temperature drop as the gases released at high speed into the reducer expand.

Again, the helical spring situated in the compensating chamber is completely covered in thermally insulating material in order to prevent the formation of ice around it too.

This thermally insulating component may comprise a single sleeve deposited around the entire length of the shutoff member contained in said chamber and made of a relatively deformable material; or it may comprise two components sliding telescopically and leaktightly over each other, one being connected to the hollow piston-shaped end of the shut off member and the other to the dividing wall positioned between the two chambers.

In all the possible alternatives cited, however, efficient insulation of the parts which it is intended to protect from the formation of ice is ensured. Thus, in the embodiment illustrated in FIG. 8, in which the first stage is of the diaphragm type, during delivery both the diaphragm and the regulator body tend to cool down and freeze the water present around the spring. The insulating covering of the diaphragm limits the extraction of heat from the compensating chamber and hence the formation of said ice. In addition, it is clear that the spring itself protected by resilient thermally insulating paint will retard the process of ice formation between its turns in the same way as in the piston version of the regulator.

The invention as described and as claimed below is nonetheless proposed purely by way of example, it being intended that it can be modified or varied in many ways which would still remain within the scope of the inventive concept. For example, it is possible to make the first stage as a whole in aluminium alloys, given the greater level of thermal conductivity of aluminium alloys compared with the brass usually used for known reducers.

I claim:

1. A first reducing stage for a two-stage scuba regulator, comprising:

a pressure chamber which communicates with a high pressure gas source;

a compensating chamber separated from said pressure chamber by a partition wall having a hole therein;

an axially movable tubular shutoff member which extends sealingly through said hole in said partition wall and which has an inlet end in said pressure chamber and an outlet end in said compensating chamber;

a valve seat provided in said pressure chamber opposite to said inlet end of said shutoff member and which cooperates with said inlet end to shut off flow through said shutoff member;

a piston in said compensating chamber fastened to said outlet end of said shutoff member, said piston being axially movable in a sealing manner in said compensating chamber;

a helical pressure spring arranged around said shutoff member and between said piston and said partition wall to bias said inlet end of said shutoff member away from said valve seat, said helical spring including a thermally insulating covering;

an aperture in said compensating chamber adjacent said helical spring which provides communication between said compensating chamber and an ambient environment; and a thermally insulating component interposed radially between said helical spring and said shutoff member and disposed along an entire length of said shutoff member in said compensating chamber.

2. A first reducing stage for a two-stage scuba regulator as claimed in claim 1:

wherein said piston includes a second thermally insulating component along a surface of said piston exposed to the ambient environment in said compensation chamber; and wherein said first-mentioned thermally insulating component is a sleeve made of a relatively flexible material having a first end connected to said second thermally insulating component and a second end contacting said partition wall.

3. A first reducing stage for a two-stage scuba regulator as claimed in claim 1:

wherein said piston includes a second thermally insulating component along a surface of said piston exposed to the ambient environment in said compensation chamber; and wherein said first-mentioned thermally insulating component is a bellows sleeve made of a rigid material with a first end connected to said second thermally insulating component and a second end contacting said partition wall.

4. A first reducing stage for a two-stage scuba regulator as claimed in claim 1:

wherein said piston includes a second thermally insulating component along a surface of said piston exposed to the ambient environment in said compensation chamber; and wherein said first-mentioned thermally insulating component is a sleeve made of a rigid material with a seal between a first end of said sleeve and said second thermally insulating component and a spring which biases a second end of said sleeve in contact with said partition wall.

5. A first reducing stage for a two-stage scuba regulator as claimed in claim 1:

wherein said piston includes a second thermally insulating component along a surface of said piston exposed to the ambient environment in said compensation chamber; and wherein said first-mentioned thermally insulating component is an axial extension of said partition wall supporting a seal which slidably engages with said second thermally insulating component.

6. A first reducing stage for a two-stage scuba regulator as claimed in claim 1:

wherein said piston includes a second thermally insulating component along a surface of said piston exposed to the ambient environment in said compensation chamber; and wherein said first-mentioned thermally insulating component is an axial extension of said second thermally insulating component, said extension terminating at a distal end contacting said partition wall.

7. A first reducing stage for a two-stage scuba regulator as claimed in claim 1:

wherein said piston includes a second thermally insulating component along a surface of said piston exposed to the ambient environment in said compensation chamber; and wherein said first-mentioned thermally insulating component is an axial bellows extension of said second thermally insulating component, said extension terminating at a distal end contacting said partition wall.

8. A first reducing stage for a two-stage scuba regulator as claimed in claim 1:

wherein said thermally insulating covering of said helical spring is one of a polyurethane, a silicone, and an elastomer.

9. A first reducing stage for a two-stage scuba regulator as claimed in claim 1:

wherein said pressure chamber and said compensating chamber are made of an aluminum alloy.

10. A first reducing stage for a two-stage scuba regulator, comprising:

a pressure chamber which communicates with a high pressure gas source, said pressure chamber including a wall, an outlet in said wall, and a valve seat adjacent said outlet;

a compensating chamber separated from said pressure chamber by a diaphragm;

an axially movable tubular shutoff member in said pressure chamber which is biased into sealing contact with said valve seat to shut off flow from the high pressure source to said outlet, said shutoff member including an axial portion which extends through said outlet and into contact with said diaphragm;

a helical spring in said compensating chamber which biases said diaphragm toward an opening movement of said shutoff member, said helical spring including a thermally insulating covering;

an aperture in said compensating chamber adjacent said helical spring which provides communication between said compensating chamber and an ambient environment; and a thermally insulating component interposed between said helical spring and said shutoff member and disposed along an entire length of said diaphragm adjacent said pressure chamber.

11. A first reducing stage for a two-stage scuba regulator as claimed in claim 10:

wherein said thermally insulating covering of said helical spring is one of a polyurethane, a silicone, and an elastomer.

12. A first reducing stage for a two-stage scuba regulator as claimed in claim 10:

wherein said pressure chamber and said compensating chamber are made of an aluminum alloy.

* * * * *